US006550766B1

(12) United States Patent
Liu

(10) Patent No.: US 6,550,766 B1
(45) Date of Patent: Apr. 22, 2003

(54) BUILT-UP TOY FOOTBALL EJECTOR

(76) Inventor: Kuo-Ching Liu, 5 Fl., No. 11, Alley 1, Lane 1, Sec 1, Yunhan S. Rd., Lujou, Taipei (TW), 247

( * ) Notice: Subject to any disclaimer, the term of this patent is extended or adjusted under 35 U.S.C. 154(b) by 0 days.

(21) Appl. No.: 10/119,218

(22) Filed: Apr. 10, 2002

(51) Int. Cl.[7] ..... A63F 7/06

(52) U.S. Cl. ..... 273/129 R; 273/119 R; 273/108.1; 273/317.1

(58) Field of Search ..... 273/129 R, 129 P, 273/129 T, 118 R, 119 R, 108.1, 108.4, 317.1; 446/429

(56) References Cited

U.S. PATENT DOCUMENTS 2,532,646 A * 12/1950 Severin ..... 273/129 R
3,086,778 A * 4/1963 Maurer ..... 273/108.55
3,952,442 A * 4/1976 Livesey et al. ..... 446/429
5,465,961 A * 11/1995 Burtch ..... 273/317.3
5,711,522 A * 1/1998 Wiggs et al. ..... 273/129 S
6,475,052 B1 * 11/2002 Liu ..... 446/88

* cited by examiner

*Primary Examiner*—Raleigh W. Chiu
(74) *Attorney, Agent, or Firm*—Troxell Law Office PLLC

(57) ABSTRACT

A built-up toy football ejector includes an ejector and a ball structure assembled from a plurality of flat parts. The ejector includes a horizontal top part connected to and supported on multiple legs, each of which is formed from an angled upper part and an outward inclined lower part, so that the ejector can be positioned on a supporting plane and defines a hollow space below the horizontal top part. The ball structure is so sized that a large part of it could be positioned in the hollow space below the ejector. When a downward force applied on the ejector exceeds a clamping force applied on the ball structure by the horizontal top part and the supporting plane, the ball structure is ejected from the hollow space to create a dynamic effect.

5 Claims, 6 Drawing Sheets

BUILT-UP TOY FOOTBALL EJECTOR

BACKGROUND OF THE INVENTION

1. Field of the Invention

The present invention relates to a built-up toy football ejector, and more particularly to a built-up toy that includes a toy ejector for ejecting a toy football to create a dynamic effect.

2. Description of the Prior Art

A built-up toy includes a plurality of flat parts that are initially formed on a board structure by stamping and can be separated from the board structure easily to assemble into a desired toy or model by engaging slits preformed thereon with one another.

The currently commercially available built-up toys are designed to construct only stationary and monotonous animals, plants, articles, etc., such as dinosaurs, dolls, and furniture. These built-up toys provide only still models and are therefore less interesting and attractive for play.

It is therefore desirable to develop a built-up toy that provides a dynamic effect.

SUMMARY OF THE INVENTION

A primary object of the present intention is to provide a built-up toy football ejector that includes an ejector and a ball structure assembled from a plurality of flat parts. When the ejector is subjected to an increasing force downward applied on a top thereof, the ball structure positioned below the ejector is finally ejected to create a dynamic effect.

Another object of the present invention is to provide a built-up toy football ejector including an ejector and a ball structure both being assembled from a plurality of flat parts. The flat parts are initially formed on a whole piece of board by stamping and can be easily separated from the board for use. Therefore, the built-up toy before being assembled into a designed form occupies only very small space and is suitable for selling alone or along with other merchandise.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
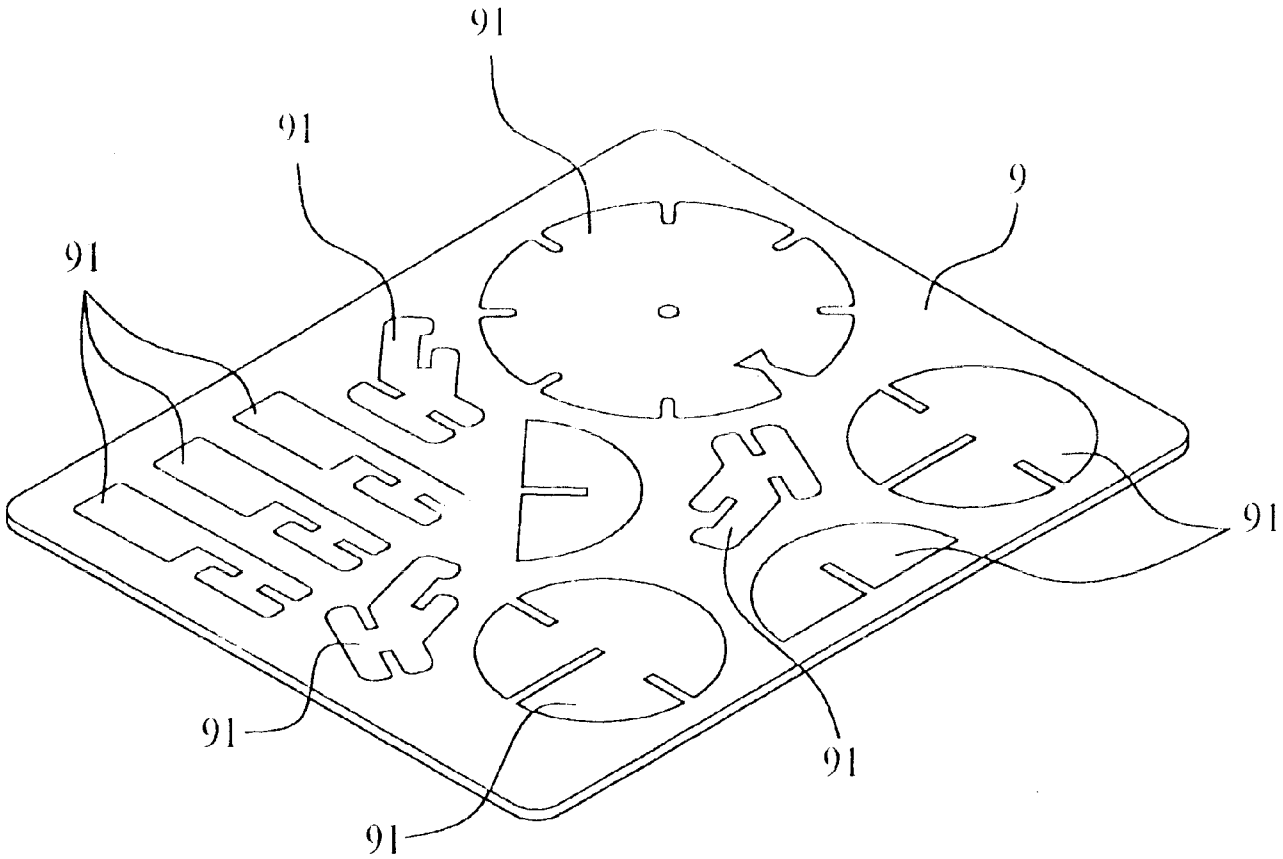
FIG. 1 shows a board containing parts for building up the toy football ejector of the present invention.

Please refer to FIG. 1 that shows a board 9 on which a plurality of flat parts 91 designed for assembling into a toy football ejector of the present invention are formed with a stamping die. The board 9 may be made of plastic material or rigid paper. The board 9 is so stamped that every part 91 can be easily separated from the board 9 for use. It is not necessary to include all the parts 91 for building up the toy football ejector of the present invention in one single piece of board 9. Two or more pieces of boards 9 may be used to include the parts 91. For example, a first board 9 contains parts 91 for building up a toy ejector while a second board 9 contains parts 91 for building up a toy football.

Figure 2:
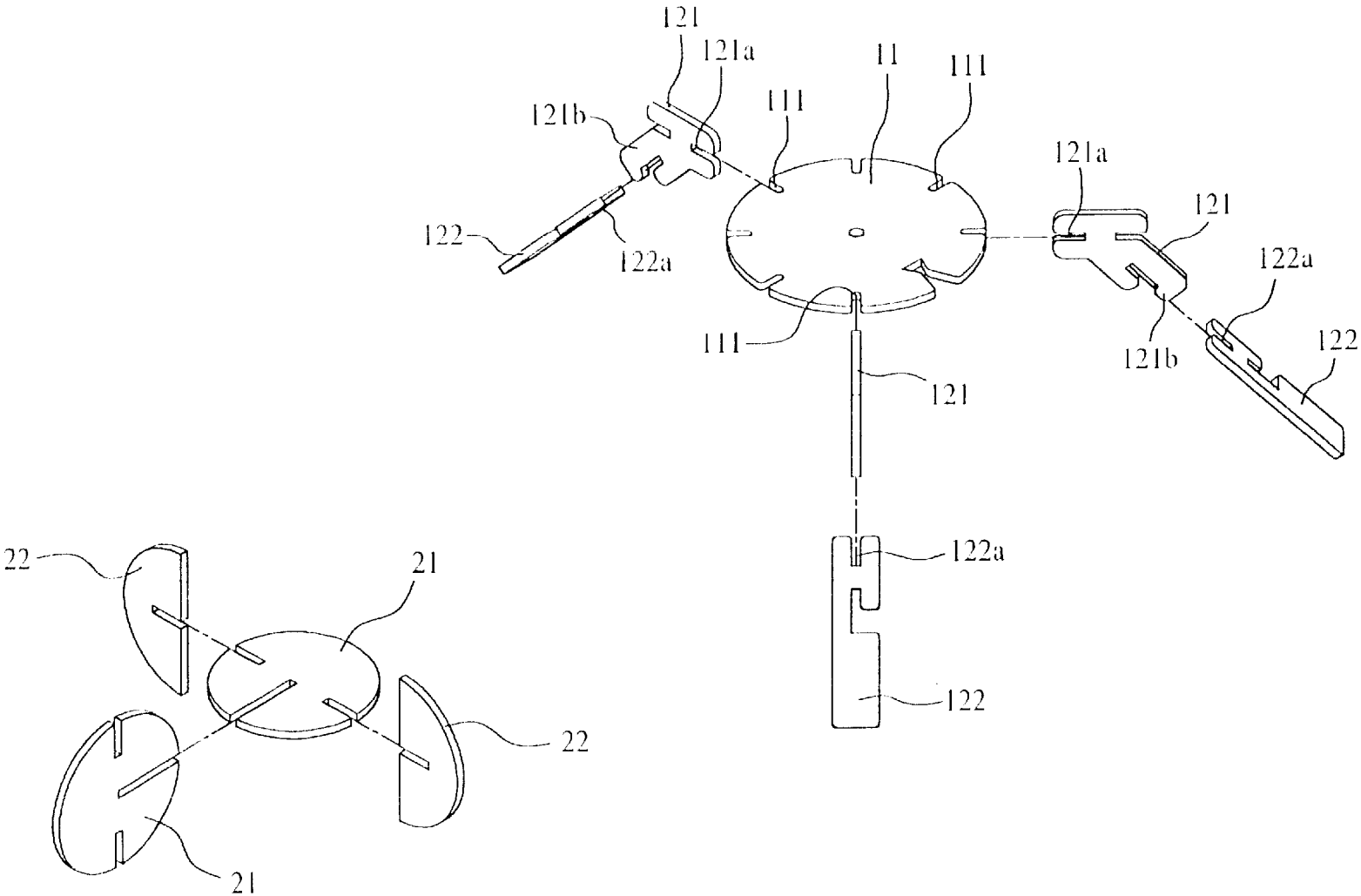
FIG. 2 is an exploded perspective view of the built-up toy football ejector of the present invention.
Figure 3:
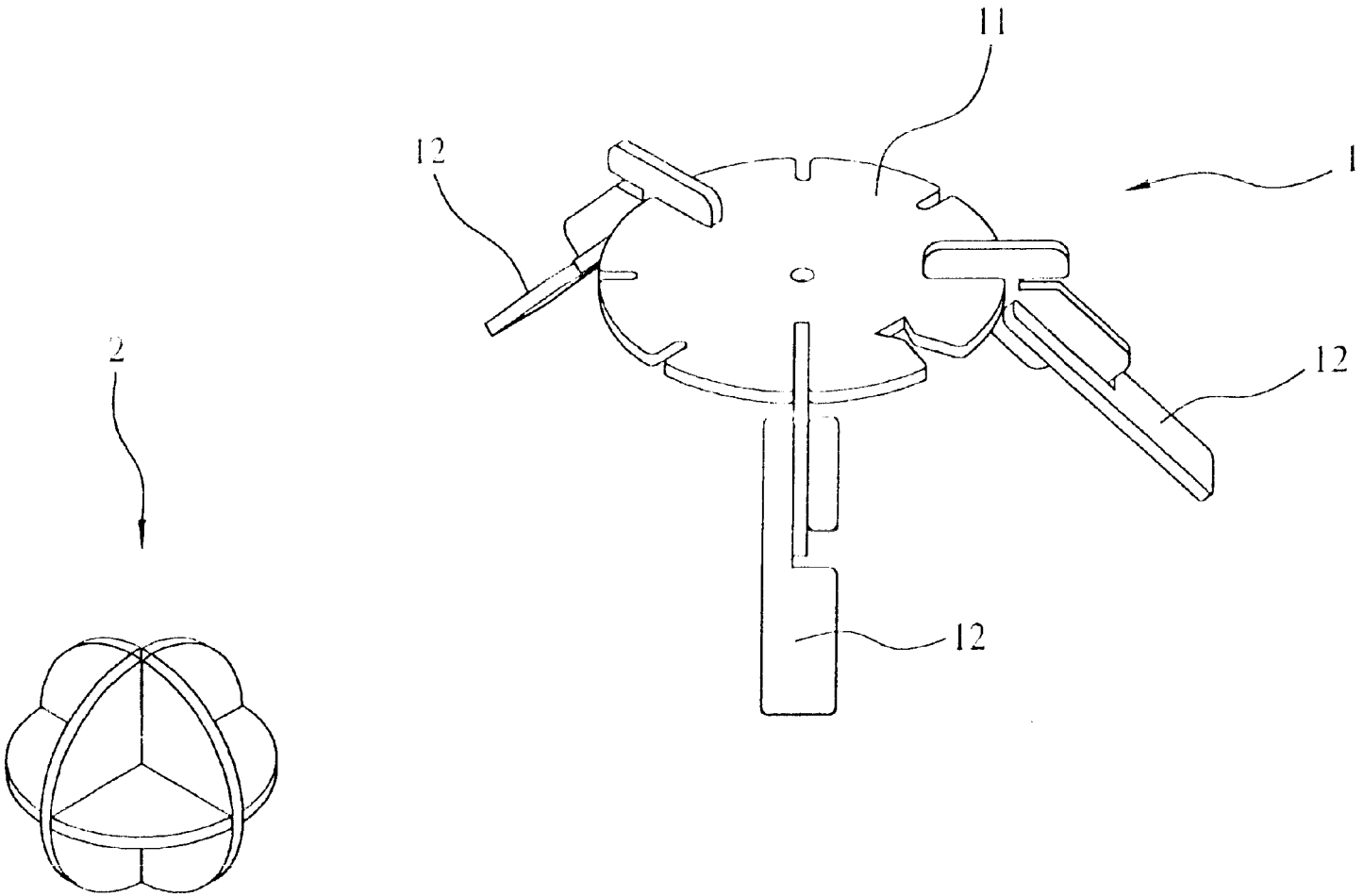
FIG. 3 is an assembled perspective view of FIG. 2.

Please refer to FIGS. 2 and 3 that are exploded and assembled perspective views, respectively, of a built-up toy football ejector of the present invention. As shown, the present invention includes an ejector 1 and a ball structure 2.

The ejector 1 is built up from a horizontal top part 11 and three outward inclined legs 12, each of which is built up from an angled upper part 121 and an outward inclined lower part 122. The horizontal top part 11 is provided along an outer periphery with at least three spaced first slits 111; the angled upper part 121 is provided at an upper front end with a second slit 121*a*, and at a lower rear end with a connecting nose 121*b*; and the outward inclined lower part 122 is provided at an upper end with a third slit 122*a*. The angled upper parts 121 are separately connected to the horizontal top part 11 by engaging the second slits 121*a* with the three spaced first slits 111, and the outward inclined lower parts 122 are separately connected to the angled upper parts 121 by engaging the third slits 122*a* with the connecting noses 121*b*, so that the horizontal top part 11 is connected to and supported on upper ends of the three legs 12 built up from the angled upper parts 121 and the outward inclined lower parts 122 to form the ejector 1. When the ejector 1 is positioned on a supporting plane, a hollow space is defined between the horizontal top part 11 and the supporting plane.

The ball structure 2 is built up from two circular parts 21 and two semicircular parts 22, all of these parts are provided with connecting slits. To form the ball structure 2, first connect the two circular parts 21 at their connecting slits, so that they perpendicularly intersect each other. Thereafter, connect the two semicircular parts 22 to one of the two intersected circular parts 21 to locate them at two opposite sides of the other circular part 21. The assembled ball structure 2 is so sized that at least a large part of it could be positioned in the hollow space defined between the horizontal top part 11 and the supporting plane below the ejector 1.

Figure 4:
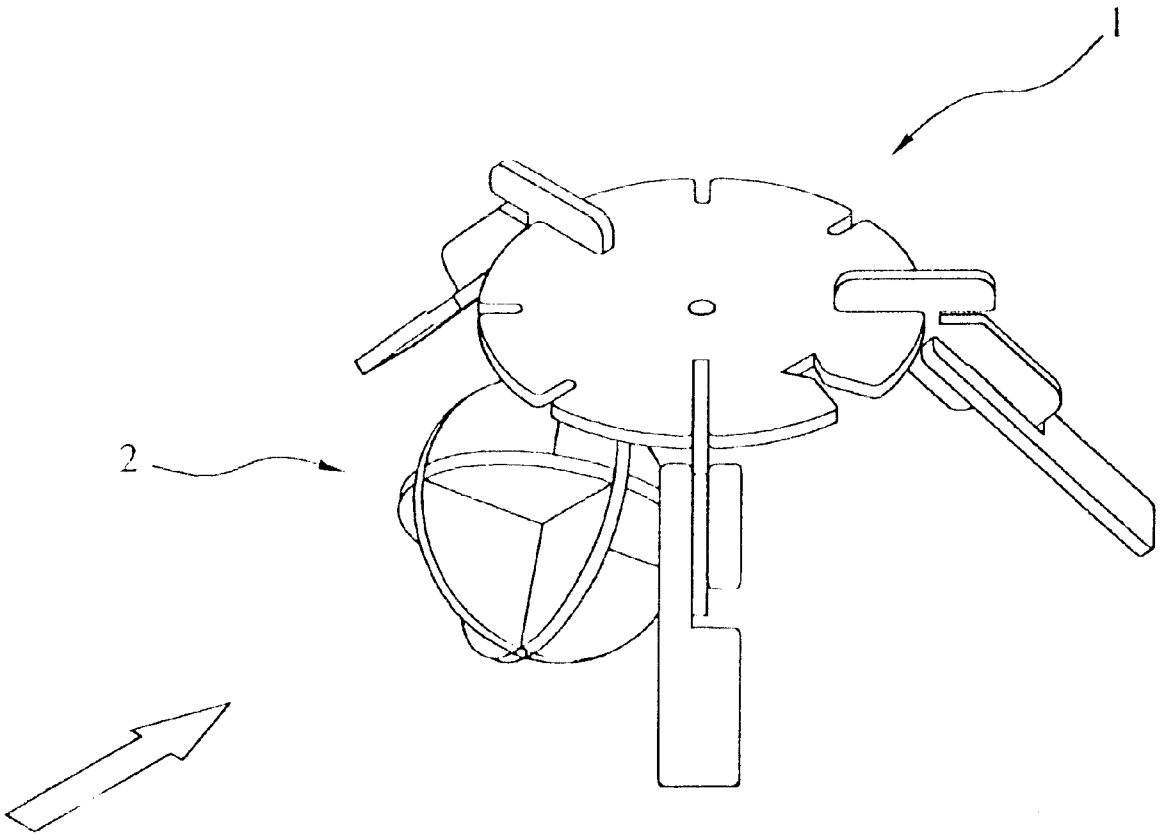
FIG. 4 shows the first step of playing the built-up toy football ejector of the present invention.
Figure 5:
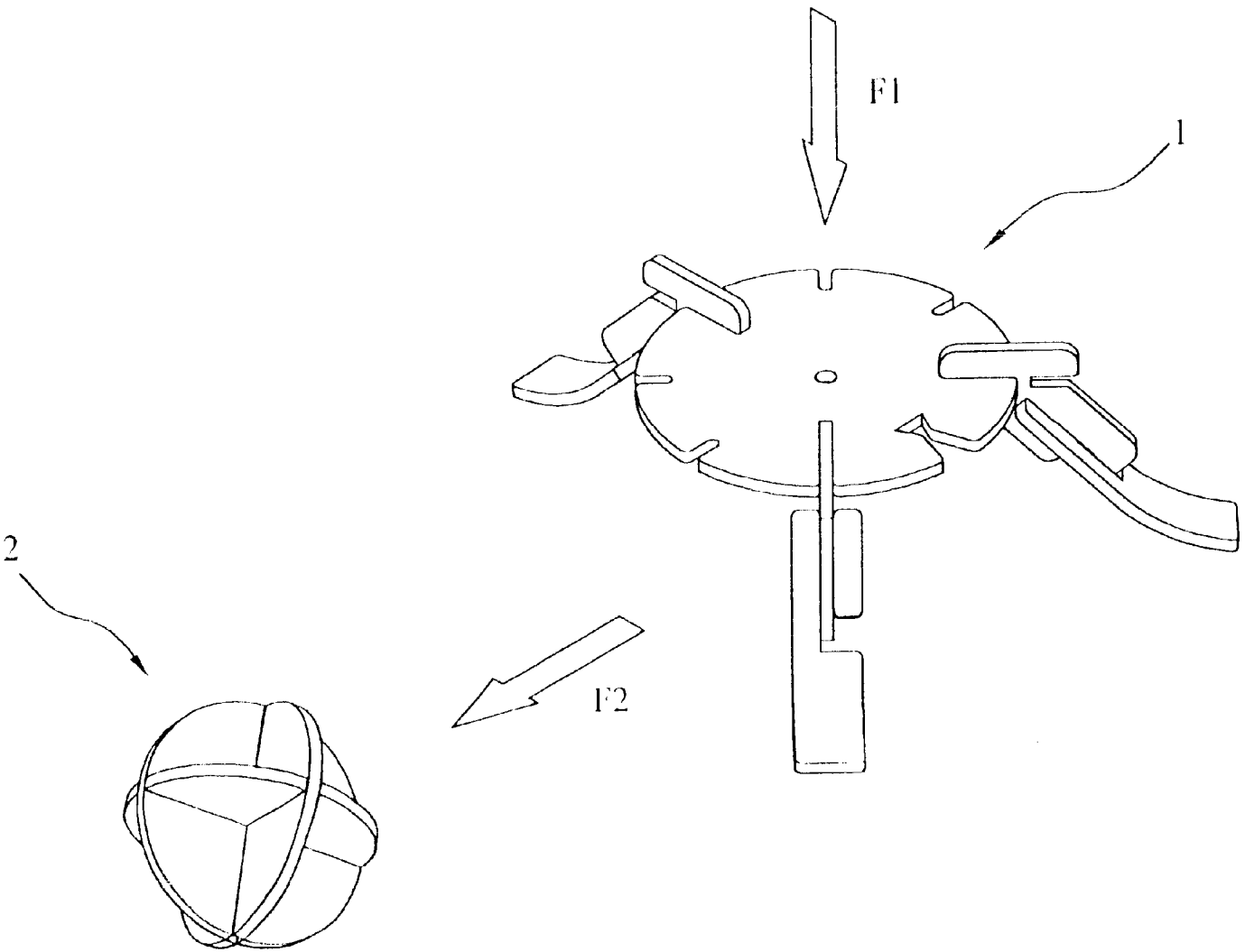
FIG. 5 shows the second step of playing the built-up toy football ejector of the present invention.

To play the built-up toy football ejector of the present invention, first separate the flat parts 91 from the board 9 shown in FIG. 1, and then assemble the separated parts 91, that separately correspond to the horizontal top part 11, the angled upper parts 121, the outward inclined lower parts 122, the circular parts 21, and the semicircular parts 22, into the ejector 1 and the ball structure 2 in the above-described steps. Thereafter, position at least a large part of the assembled ball structure 2 in the hollow space below the horizontal top part 11 of the assembled ejector 1, as shown in FIG. 4. Then, apply a downward force on a top of the horizontal top part 11, as indicated by the arrow F1 in FIG. 5, so that the ball structure 2 is clamped between the horizontal top part 11 and the supporting plane below the ejector 1. Gradually increase the downward applied force until it is larger than a clamping force applied on the ball structure 2 by the ejector 1 and the supporting plane. At this point, the ball structure 2 is ejected from the hollow space below the ejector 1 in a direction indicated by the arrow F2.

The present invention creates a dynamic effect and is therefore more interesting and more attractive than conventional stationary built-up toys.

Figure 6:
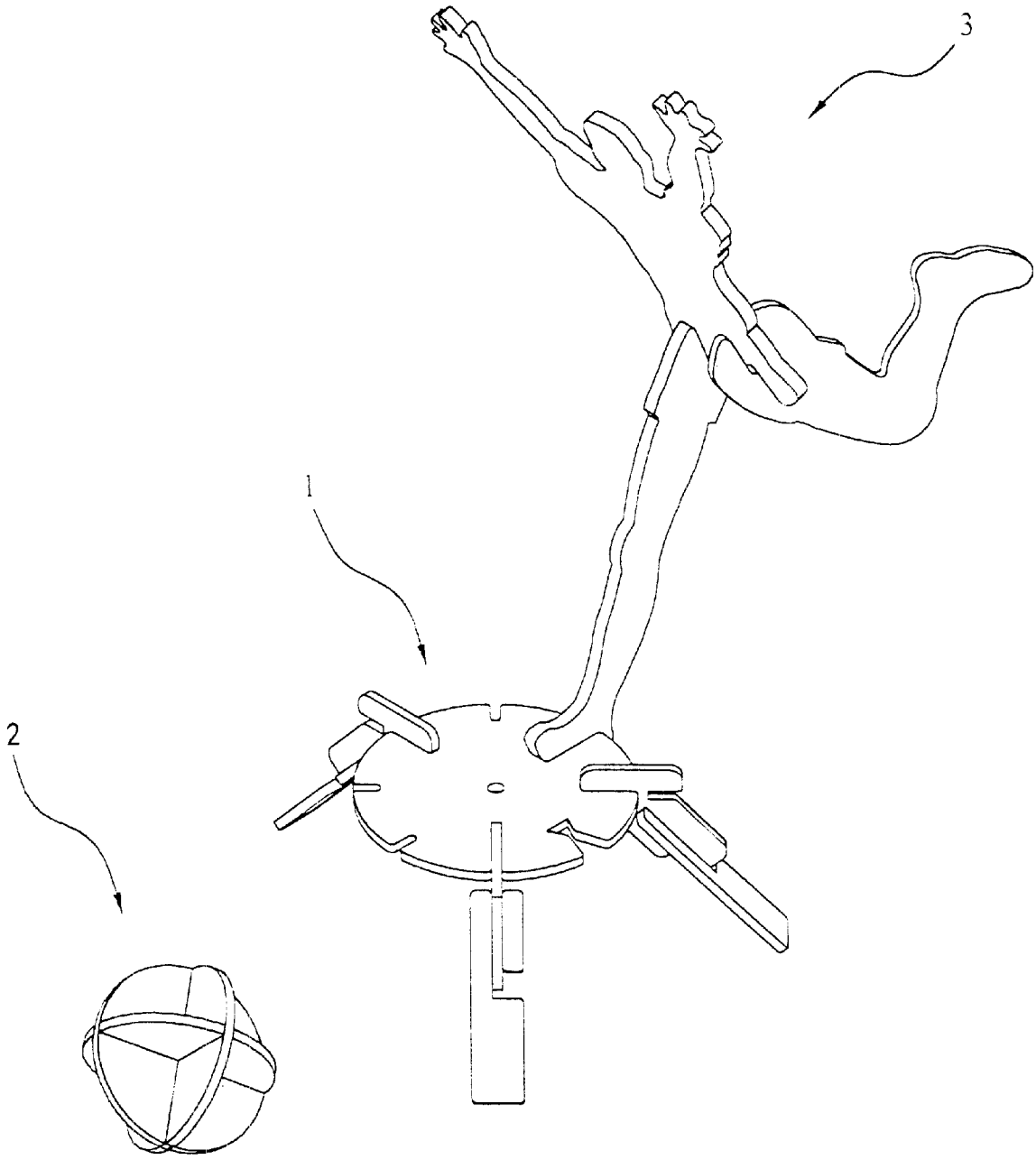
FIG. 6 shows the built-up toy football ejector of the present invention having a built-up toy football player connected thereto.

FIG. 6 shows the ejector 1 of the built-up toy football ejector of the present invention is connected at the horizontal top part 11 to one foot of a built-up toy football player 3, making the present invention more interesting for play. Flat parts for assembling into the toy football player 3 may be included in the same board 9 that contains parts 91 for building up the ejector 1 and the ball structure 2, or be included in a separate board.

What is claimed is:

1. A built-up toy football ejector, comprising:

a ball structure assembled from a plurality of flat parts that engage with one another at preformed connecting slits in a predetermined manner; and an ejector assembled from a horizontal top part and at least three outward inclined legs, said horizontal top part being connected to and supported on upper ends of said three outward inclined legs, so that said ejector can be positioned on a supporting plane to define a hollow space between said horizontal top part and said supporting plane, and said hollow space being so sized that it can receive at least a large part of said ball structure therein;

whereby when said ball structure is partially positioned in said hollow space below said horizontal top part of said ejector and a gradually increased force is downward applied on said horizontal top part to finally exceed a clamping force applied on said ball structure by said horizontal top part and said supporting plane, said ball structure is ejected from said hollow space to create a dynamic effect.

2. The built-up toy football ejector as claimed in claim 1, wherein said flat parts for assembling into said ball structure and said ejector are initially formed on one or more piece of boards in a predetermined manner.

3. The built-up toy football ejector as claimed in claim 1, wherein said flat parts for assembling into said ball structure include two circular parts and two semicircular parts.

4. The built-up toy football ejector as claimed in claim 1, wherein each of said legs for said ejector is assembled from an angled upper part and an outward inclined lower part, said horizontal top part being connected to upper ends of said angled upper parts, and said outward inclined lower parts together supporting said horizontal top part to provide said hollow space.

5. The built-up toy football ejector as claimed in claim 1, wherein said ejector is connected at said horizontal top part to one foot of a built-up football player.

* * * * *